United States Patent [19]

Errani

[11] Patent Number: 5,050,412

[45] Date of Patent: Sep. 24, 1991

[54] FLAT KEY CYLINDER LOCK WITH ANTI-BURGLAR FEATURES

[75] Inventor: Deo Errani, Faenza, Italy

[73] Assignee: Costruzioni Italiane Serrature Affini C.I.S.A. S.p.A., Faenza, Italy

[21] Appl. No.: 16,969

[22] Filed: Feb. 25, 1987

Related U.S. Application Data

[63] Continuation of Ser. No. 736,585, May 21, 1985, abandoned.

[51] Int. Cl.[5] ..... E05B 27/06

[52] U.S. Cl. ..... 70/358; 70/492; 70/386; 70/419

[58] Field of Search ..... 70/364 A, 364 R, 419, 70/421, 358, 381, 386

[56] References Cited

U.S. PATENT DOCUMENTS

| | | | |
|---|---|---|---|
| 1,961,586 | 6/1934 | Heyer | 70/364 R |
| 2,021,185 | 11/1935 | Hurd | 70/419 |
| 2,149,733 | 3/1939 | Hagendorn et al. | 70/364 A |
| 2,232,137 | 2/1941 | Rolph | 70/364 A |
| 2,578,211 | 12/1951 | Spain | 70/419 |
| 2,831,338 | 4/1958 | Spain | 70/419 |
| 3,479,849 | 11/1969 | Check | 70/419 |
| 3,656,328 | 4/1972 | Hughes | 70/364 A X |
| 3,722,240 | 3/1973 | Spain et al. | 70/419 |
| 3,985,010 | 10/1976 | Idoni | 70/419 |
| 4,377,082 | 3/1983 | Wolter | 70/364 A |
| 4,434,636 | 3/1984 | Prunbauer | 70/358 |
| 4,608,842 | 9/1986 | Tietz | 70/364 A X |
| 4,612,787 | 9/1986 | Prunbauer | 70/364 A X |
| 4,638,651 | 1/1987 | Surko Jr. | 70/364 A |

FOREIGN PATENT DOCUMENTS

| | | | |
|---|---|---|---|
| 1260340 | 2/1968 | Fed. Rep. of Germany | 70/358 |
| 2003059 | 7/1971 | Fed. Rep. of Germany | 70/364 A |
| 2931653 | 2/1981 | Fed. Rep. of Germany | 70/358 |

*Primary Examiner*—Gary L. Smith
*Assistant Examiner*—Suzanne L. Dino
*Attorney, Agent, or Firm*—Guido Modiano; Albert Josif

[57] ABSTRACT

The cylinder lock comprises a plug and auxiliary pins which are disposed in seats, provided on the plugs and arranged laterally to the channel of introduction of the key. On introducing the key into the lock the pins are displaced from their seats such that, when the key is not the right one, they will engage into recesses on the outer casing of the lock, thus inhibiting rotation of the plug. By intervening on the pins it is also possible to obtain a set of hierarchically different locks for fabricating master key systems.

3 Claims, 3 Drawing Sheets

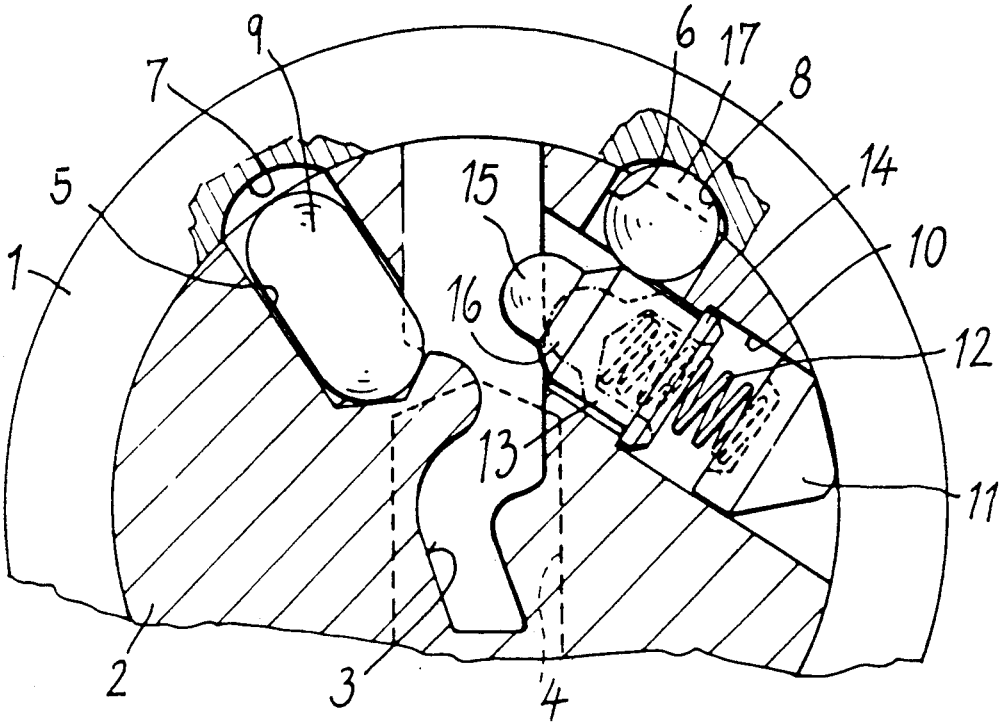
Fig. 1
Fig. 2
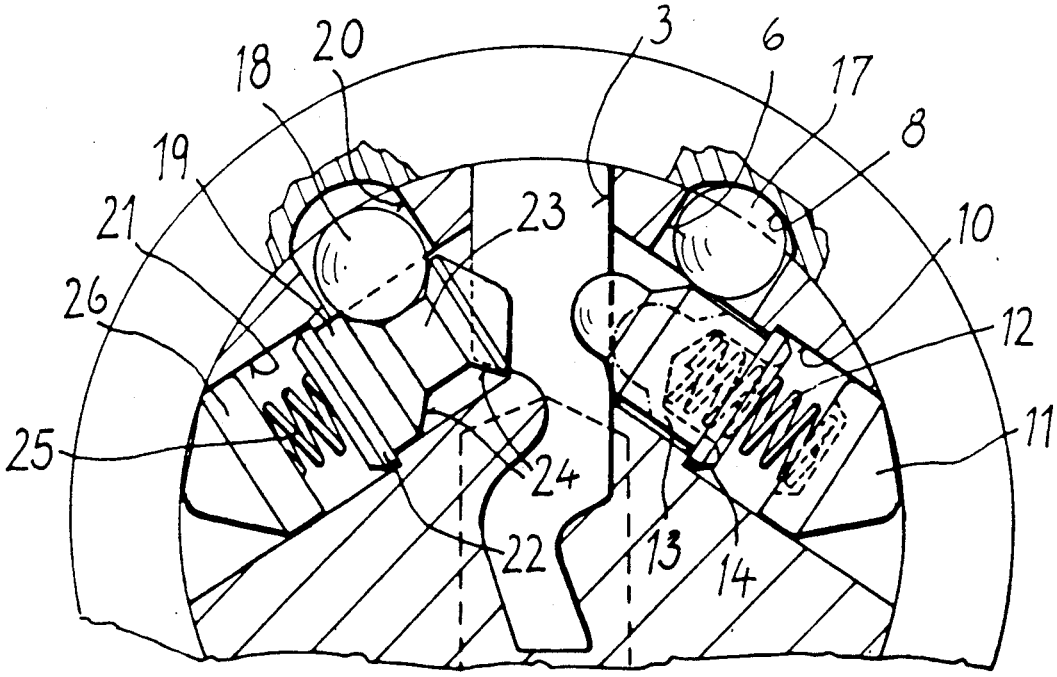

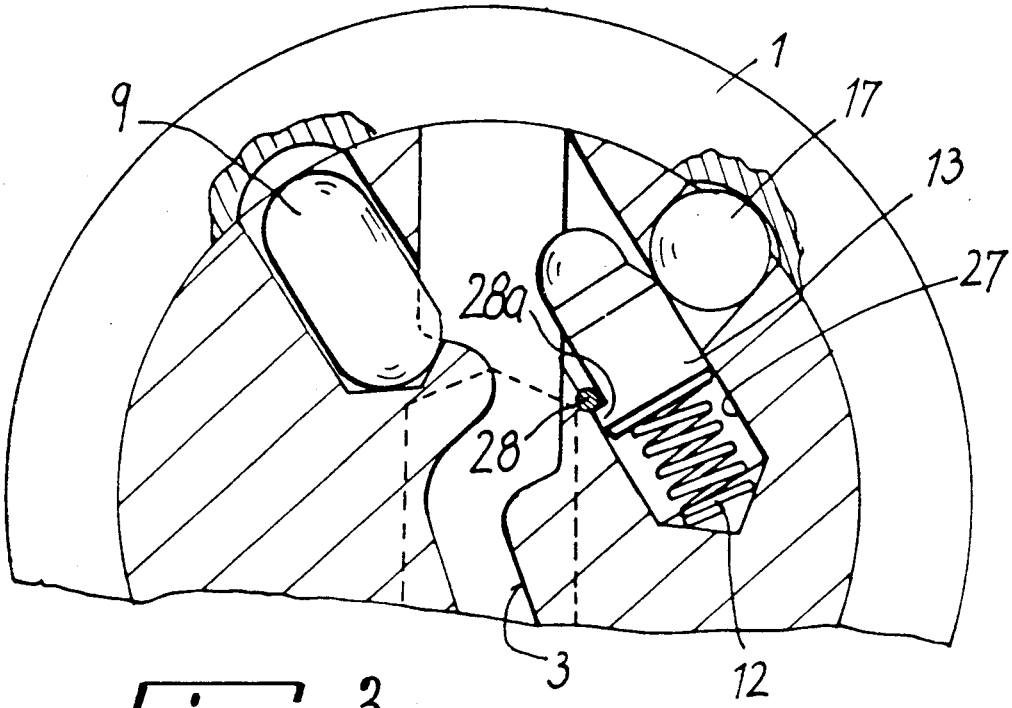
Fig. 3
Fig. 4
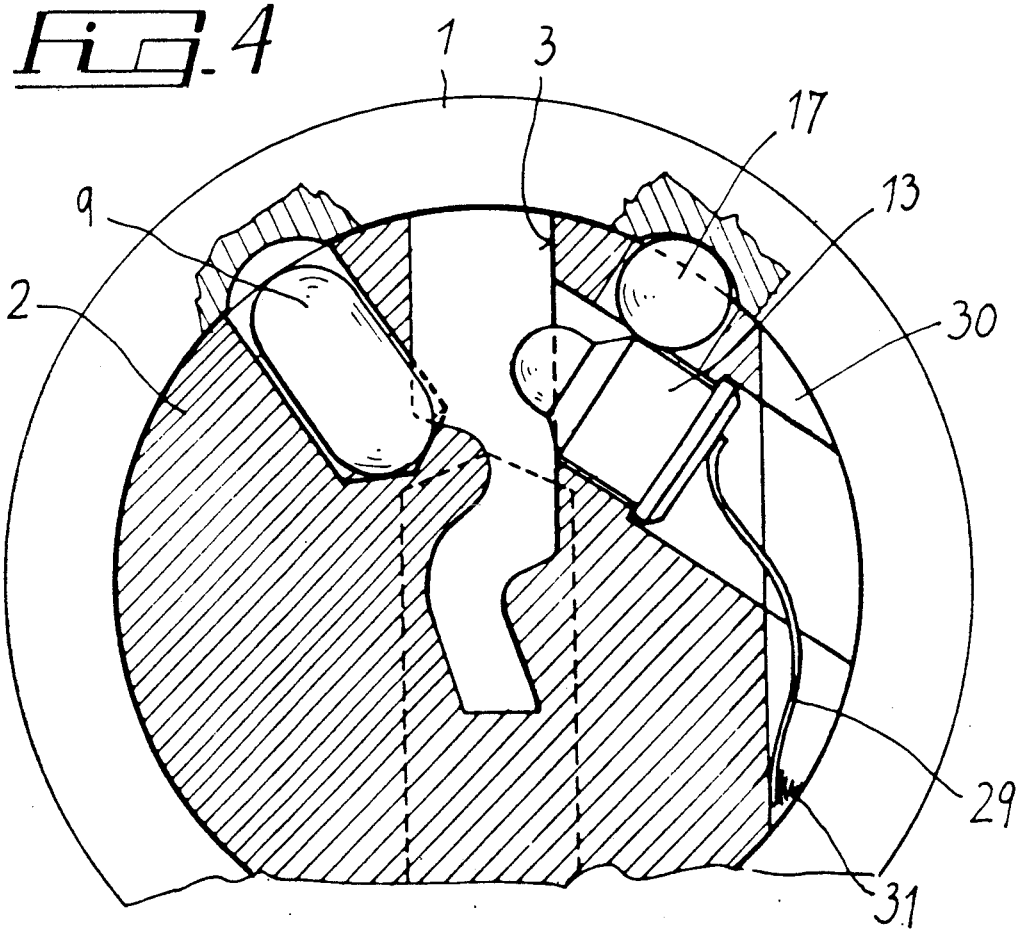

FLAT KEY CYLINDER LOCK WITH ANTI-BURGLAR FEATURES

This application is a continuation of Ser. No. 06/736,585 filed May 21, 1985, and now abandoned.

BACKGROUND OF THE INVENTION

This invention relates to a flat key cylinder lock with anti-burglar features.

Known are flat key locks where, in addition to the usual bolt pins and counter-pins slided by the key dents, auxiliary side pins are provided which are slided by the key flanks and provide an added measure of burglar-proof ability.

Locks of this type are known, for example, from German Patent No. 2003059, in which the auxiliary pins are arranged to extend perpendicularly to the plane of the key. The pin action results from that, on the pins being slided sideways by the key being pushed in, they move out of the plug outer surface to engage in recesses formed in the cylindrical casing in which the plug is received rotatably. The proper key is formed with notches which, on the key being inserted into the lock, enable the auxiliary pins to retract by reaction effect as the plug is rotated. The pin retraction is facilitated by the crowned shape of the recesses.

When a bogus key is used, the notches and pins mismatch, and accordingly, the pins are held in a position of engagement with the recesses and prevent the plug from turning.

The burglar resisting ability of the known auxiliary pins is, in actual practice, rather unreliable because it can be easily overcome by effecting removal thereof lengthwise to the key profile at the areas abutting the auxiliary pins, that is by milling out the key flanks longitudinally, thereby the pins are allowed to slide freely in their seats. Such a deceptively machined key (referred to in the jargon as a "relieved" key) allow unrestricted sliding for the auxiliary pins which are, therefore, free to retract as the plug is rotated.

The published German Patent Application No. 31 23 511 discloses a lock provided with holes for the auxiliary pins perpendicular to the usual pins and counter-pins and having the same or a larger diameter than the latter. With a "relieved" key, the counter-pins, after a 90° rotation, can fit into the holes for the auxiliary pins and make the lock fast. With a non-relieved key, the plug rotation would be hindered by the auxiliary pins being held engaged with the notches in the cylinder casing.

A lock according to the above disclosure has the disadvantage that when the lock is made fast in the rotated position, the bogus key cannot be removed and the lock is rendered unreusable.

SUMMARY OF THE INVENTION

It is the technical aim of this invention to provide a cylinder lock having auxiliary pins which can obviate the drawbacks of the known ones, that is, can resist burglary efforts using deceptively "relieved" keys.

Within the above aim, it is an object of this invention to provide a lock which is suitable for use in locking systems with hierarchically different keys in conformity with a scale comprising multiple levels.

That aim is achieved by a cylinder lock having a plug and auxiliary pins disposed in seats on the plug and controllable by key flanks to engage in recesses on an outer casing of said cylinder lock and inhibit rotation of said plug, each of said key flanks being adapted for cooperation with a respective set of auxiliary pins, each set comprising at least two pins, at least one thereof being adapted for engagement with at least one of said recesses on said outer casing, when a key inserted thereinto lacks a corresponding notch, adapted to receive at least one of said auxiliary pins over a sufficient distance to allow rotation of said plug, whilst at least one other of said auxiliary pins in said respective set of auxiliary pins cooperates with interference means adapted for engagement with at least one of said recesses on said outer casing to inhibit rotation of said plug when said key is removed and adapted for enabling rotation of the plug when the key is inserted.

BRIEF DESCRIPTION OF THE DRAWINGS

Further features and advantages of the invention will become apparent from the following detailed description of some embodiments thereof, with reference to the accompanying illustrative drawing, in which:

FIG. 1 is a fragmentary sectional view of a cylinder lock according to a first embodiment of this invention;

FIG. 2 is a fragmentary sectional view of a cylinder lock according to a second embodiment of the invention;

FIG. 3 is a fragmentary sectional view of a third embodiment of the invention; and FIG. 4 is a fragmentary sectional view of a fourth embodiment.

DESCRIPTION OF THE PREFERRED EMBODIMENTS

Figure 5:
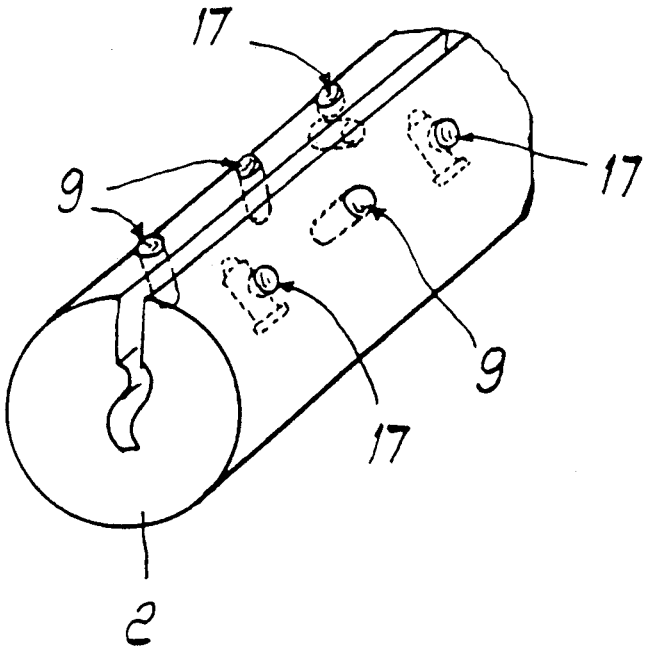
FIG. 5 is a diagrammatic perspective view of the plug of the cylinder lock of this invention.

With reference to FIG. 1, this lock comprises a cylindrical casing 1, on the interior of which a cylindrical plug 2 is set rotatably.

The cylindrical plug 2 is formed, in a known manner no further illustrated herein, with a lengthwise channel or flute 3 having a shaped profile to receive the operating key, as well as with a plurality of holes 4 aligned on a longitudinal plane coinciding with the lock centre-plane and accommodating the usual pins or bolt pins which, in cooperation with the counter-pins, are driven by the lock actuating key.

The plug 2 has additional holes 5,6 formed therein alongside the channel 3 and being oriented in a radial direction. The hole 6 is part of a first type of auxiliary locking pin unit described below and the hole 5 is part of a second type of auxiliary locking pin unit.

The holes 5,6 extend in planes containing an axis which substantially, but not necessarily, coincides with the axis of the plug 2.

With the lock in the position shown, which is the position with the key disengaged, the holes 5,6 are aligned with recesses 7,8 in the form of longitudinal grooves having an arcuate cross-section and being formed on the inner walls of the casing 1.

The hole 5 is in communication with the channel 3 and accommodates a cylindrical pin 9 having each of its opposed ends configured as a spherical cap. As visible in FIG. 1 pin 9 has an actuation surface position 9*a* projecting into the channel 3 and a locking formation 9*b* normally out of engagement with the recess 7.

A hole 10 is also formed in the plug 2 which intersects the hole 6 orthogonally thereto and opens into the channel 3.

The hole 10 is closed on the side of the casing 1 by a pellet or plug nut 11 force fitted to provide support for a compression spring 12 which penetrates, with its opposed end, a recess formed in a pin 13 guided in the hole 10.

The pin 13 is provided at one end with a flange 14 which, owing to the bias force applied by the spring 12, is held at one end against a shoulder of the hole 10, and at the other end, with a hemispherical head 15 merging with the cylindrical body of the pin 13 through a conical collar 16. The hemispherical head 15 provides an actuation surface portion normally protruding into the channel 3.

The abutment shoulder for the flange 14 in the hole 10 is positioned such that the hemispherical head 15 partially protrudes into the channel 3. Further, the depth of the hole 6, when combined with that of the recess 8, will equal the diameter of the hole 6, so that it can accommodate a ball 17 of the same diameter. The ball 17 provides a locking formation normally in engagement with the recess 8 to exert a locking action between plug 2 and casing 1.

It should be noted that, with the flange 14 abutting against the shoulder in the hole 10, the ball 17 is prevented from coming out of the hole 6 by the body of the pin 13 blocking access to the hole 10.

In the above description, reference has been made, for reasons of clarity, to a single hole 5 formed on one side of the channel 3 and to a single pair of mutually intersecting holes 6,10, formed on the other side of the same hole. Actually, it is envisaged that, on each side of the channel 3, i.e. on the same side of channel 5, a set of holes be provided, each comprising at least one hole 5 and respective pin 9 and a pair of holes 6, 10 and respective pins 13 and ball 17 as visible in FIG. 5. It will be understood from the foregoing, that on the same side of the channel 3 two different types of auxiliary locking pin units are provided, i.e. a first type including the radial hole 6, the ball 17, the transverse hole 10 and the pin 13 and on the same side a second type of auxiliary locking pin units including the radial hole 5 and the pin 9.

The lock just described is operated by means of a key having side notches arranged such that, with the key inserted into the channel 3, each notch faces one hole 5 to receive in said notch the pin 9. Furthermore, the key can act with its flanks or lands directly on the pins 13 and push them back into the holes 10 against the bias of the spring 12.

As shown clearly in FIG. 1, with the key removed, the plug 2 is inhibited from turning by, in addition to the actions of the pins and counter-pins housed in the holes 4, by the locking action of locking formations in the form of spherical surface position of the ball 17 which cannot retract into the hole 6 owing to the pin 13 blocking it from moving.

On inserting the proper key into the channel 3, the pins 9 retain their freedom of movement due to the provision of corresponding notches on the key which enable the pins 9 to penetrate the channel 3. Simultaneously, the key flanks i.e. actuating land portions thereof push into the holes 10 the pins 13 by acting on the actuation surface portions thereof, provided by the tapered end parts 15, 16 of the auxiliary pin 13, thereby the ball 17 can move down the conical region 16 and stop agains the spherical head 15, thus disengaging from the recess 8. Owing to the pins in the holes 4 being positioned by the key dents in the shear plane between the plug 2 and casing 1, the plug 2 may now be turned.

If a bogus "relieved" key is introduced into the channel 3 from either end, there will be at least one pin 13 which retains its position shutting off the ball 17 and, hence, the plug 2.

If the bogus key is not correctly relieved, the inhibiting function is assumed by at least one of the pins 9 being pushed back into the recess 7 to the plug blocking position.

As may be seen, the lock can provide a better safeguard than traditional ones, since the auxiliary pins not only widen the range of key coding, but also compel any ill-intentioned person surriptitiously attempting to pick the lock to manipulate pins which are difficult to locate.

In practicing the invention, many modifications and variations are feasible especially in respect of the auxiliary pin fashioning.

In the embodiment of FIG. 2, the pin 9 is replaced by a ball 18 and a pin 19. The ball 18 is accommodated in a radial hole 20 which intersects the hole 21 perpendicularly wherein the pin 19 is slidable.

Relatively to the lock centreplane, the hole 21 is symmetrical to the hole 10 and opens into the channel 3 for the key at a position which need not necessarily be juxtaposed to the hole 10.

The pin 19 is provided with a flange 22 and an annular groove 23 defined by two flaring walls 24. The flange 22, similarly to the flange 14, is urged against a shoulder in the hole 21 by a spring 25 which rests on a plug nut 26 in the hole 21.

With the proper key, the ball 18 will be facing the groove 23 and is free to move in the hole 20, disengaging from the recess 7 and allowing the plug 2 to be rotated. By contrast, if the key has no notches, the ball 18 will remain in tangent contact with the periphery of the pin 19, while in engagement with the recess 7 and preventing the plug 2 from rotating.

In FIG. 3, there is shown a solution wherein the hole 27 accommodating the auxiliary pins is formed through the channel 3 for the key. Thus, no plug nuts are required, whilst to prevent the pins from leaving their seats, there are provided axial pins 28 which, by interfering with a side bevel 28*a* of the auxiliary pins, also prevent them from turning.

In FIG. 4, lastly, there is shown an embodiment wherein the cylindrical springs 12 are replaced with leaf springs 29 each inserted into a respective slot 30 cut through the periphery of the plug 2 perpendicularly to its axis and intersects the hole 10 diametrically. The spring 29 has one end secured by caulking the slot borders at 31 and the other end acting on the pin 13 to bias it toward the position of engagement with the channel 3 for the key.

One of the basic features of the inventive locks is that they enable the fabrication of so-called master key systems, wherein the locks may be operated in conformity with hierarchically different levels, in the sense that keys of person of hierarchically higher level can operate locks of persons of lower levels, but not vice versa. Diversification may be achieved by intervention on the key flanks and respective side pins. Thus, the highest key in the hierarchy will have notches for receiving the pins 9 and lands for pushing back the pins 13 of all the locks. The lower level locks may have one or more auxiliary pins 9,13 missing.

The presence of the spring-loaded pins 13 inhibits the fabrication of keys of a higher hierarchical level by "relieving".

The hierarchy to be obtained with the auxiliary pins may be combined with that to be obtained with the usual pins and counter-pins, thereby a much differentiated hierarchical scale can be provided.

I claim:

1. In a cylinder lock comprising a casing having an axial cylindrical bore defining inner wall, a cylindrical plug arranged in said axial cylindrical bore rotatable about an axis of rotation of said cylindrical plug, means defining a channel formed in said plug for receiving there in a proper key, the key including lateral actuating land formations and lateral notch formations, said channel being directed axially along said axis of rotation, said plug having a normal key insertion angular position with respect to said casing, main tumbler pin means in said plug and said casing, at least one first auxiliary locking pin unit in said plug and said casing, wherein said first auxiliary locking pin unit is of the type having first locking formations normally preventing rotation of said plug with respect to said casing when the key is removed from the channel, said first locking pin unit type further having actuation surface portions normally protruding into said channel and actuated by said actuating land formations of the proper key when inserted into said channel thereby disactivating the locking action of said first locking pin unit to thereby allow rotation of said plug with respect to said casing, the improvement comprising at least one second auxiliary locking pin unit of a type different from said first auxiliary locking pin unit and arranged in said plug and said casing at a distance from said first auxiliary locking pin unit, and wherein at least one of said first auxiliary locking pin units and at least one of said second auxiliary locking pin units are both arranged on the same side of said channel, and wherein said second auxiliary locking pin unit is of the type having second locking formations normally allowing rotation of said plug with respect to said casing when the key is removed from the channel, and wherein said second locking pin unit type has second actuation surface portions normally protruding into said channel and normally received in notch formations on the proper key when the key is inserted into said channel to allow free rotation of the plug with respect to the casing when the proper key is inserted therein and for locking said plug onto said casing when said second actuation surface portions are actuated by land formations provided on a bogus key inserted into said channel.

2. A cylinder lock according to claim 1, wherein said first auxiliary locking pin unit comprises a first longitudinal groove in said inner wall facing said plug, extending in a cross-sectional area of said plug and intersecting said groove, a first substantially radial hole in said plug and opening at said inner wall to face said first longitudinal groove when said plug is in said normal key insertion angular position thereof, extending in said cross-sectional area of said groove a first transverse hole transversely intersecting said first radial hole to define an internal open end of said radial hole opening laterally into said transverse hole, said transverse hole opening with one end thereof into said channel, a first auxiliary pin slidably guided in said first transverse hole from a retracted position thereof into an expanded position thereof and vice versa and having a tapered end facing said channel and a cylindrical land portion normally facing said radial hole when said first auxiliary pin is in the expanded position thereof, said tapered end having said first actuation surface portions, spring means normally urging said first auxiliary pin towards said channel to partially protrude therein with said tapered end thereof and to intercept said radial hole with at least a part of said cylindrical land portion thereof when said first auxiliary pin is in the expanded position thereof, a ball movably accommodated in said radial hole, said ball having said first locking formations thereon in the form of a surface portion thereof normally engaging said first longitudinal groove to lock said plug when said first auxiliary pin is in the expanded position thereof in which said first auxiliary pin is shifted by said spring means towards said channel to partially protrude therein with said first actuation surface portions thereof and engages said ball with said cylindrical land portion thereof, said first auxiliary pin being movable in said retracted position thereof when the proper key is inserted into said channel to act with the actuating land portions of the proper key on said actuation surface portions of the first auxiliary pin protruding into said channel and shifting said first auxiliary pin into said retracted position thereof thereby removing the engagement between said ball and said cylindrical land portion and allowing said locking formations of said ball to be released from said first groove thereby to allow free rotation between said plug and said casing and wherein said second auxiliary pin unit comprises a second longitudinal groove in said inner wall facing said plug, a second radial hole in said plug, said second radial hole having one end thereof opening into said channel and a second end thereof opening into said second longitudinal groove when said plug is in said normal key insertion angular position thereof, a second auxiliary pin slidingly arranged in said radial hole and having on one end thereof said second actuation surface portions and on the opposite end thereof said second locking formations, said second auxiliary pin being movable in said second radial channel normally from a radially retracted position, in which said second auxiliary pin is out of engagement with said second longitudinal groove and allows free relative rotation of said plug with respect to said casing and in which said second actuation surface portions thereof protrude into said channel, into a radially expanded position in which said second locking formations of said auxiliary pin engage said second longituidinal groove upon actuation of said second actuation surface portions by land portions of the bogus key.

3. A cylinder lock comprising a casing having an axial cylindrical bore defining an inner wall, a cylindrical plug arranged in said axial cylindrical bore rotatable about an axis of rotation of said cylindrical plug, means defining a channel formed in said plug for receiving therein a proper key, the key including lateral actuating land formations and lateral notch formations, said channel being directed axially along said axis of rotation, said plug having a normal key insertion angular position with respect to said casing, main tumbler pin means in said plug and said casing, at least one first auxiliary locking pin unit in said plug and said casing, wherein said first auxiliary locking pin unit is of the type having first locking formations normally preventing rotation of said plug with respect to said casing when the key is removed from the channel, said first locking pin unit type further having actuation surface portions normally protruding into said channel and actuated by said actuating land formations of the proper key when inserted into said channel thereby disactivating the locking action of said first locking pin unit to thereby allow rotation of said plug with respect to said casing, the cylinder lock further comprising at least one second auxiliary locking pin unit of a type different from said first auxiliary locking pin unit and arranged in said plug and said casing at a distance from said first auxiliary locking pin unit, and wherein at least one of said first auxiliary locking pin units and at least one of said second auxiliary locking pin units are both arranged on the same side of said channel, and wherein said second auxiliary locking pin unit is of the type having second locking formations normally allowing rotation of said plug with respect to said casing when the key is removed from the channel, and wherein said second locking pin unit type has second actuation surface portions normally protruding into said channel and normally received in notch formations on the proper key when the key is inserted into said channel to allow free rotation of the plug with respect to the casing when the proper key is inserted therein and for locking said plug onto said casing when said second actuation surface portions are actuated by land formations provided on a bogus key inserted into said channel and wherein said first auxiliary locking pin unit comprises a first longitudinal groove in said inner wall facing said plug, extending in a cross-sectional area of said plug and intersecting said groove a first substantially radial hole in said plug and opening at said inner wall to face said first longitudinal groove when said plug is in said normal key insertion angular position thereof, extending in said cross-sectional area of said groove a first transverse hole transversely intersecting said first radial hole to define an internal open end of said radial hole opening laterally into said transverse hole, said transverse hole opening with one end thereof into said channel, a first auxiliary pin slidably guided in said first transverse hole from a retracted position thereof into an expanded position thereof and vice versa and having a tapered end facing said channel and a cylindrical land portion normally facing said radial hole when said first auxiliary pin is in the expanded position thereof, said tapered end having said first actuation surface portions, spring means normally urging said first auxiliary pin towards said channel to partially protrude therein with said tapered end thereof and to intercept said radial hole with at least a part of said cylindrical land portion thereof when said first auxiliary pin is in the expanded position thereof, a ball movably accomodated in said radial hole, said ball having said first locking formations thereon in the form of a surface portion thereof normally engaging said first longitudinal groove to lock said plug when said first auxiliary pin is in the expanded position thereof in which said first auxiliary pin is shifted by said spring means towards said channel to partially protrude therein with said first actuation surface portions thereof and engage said ball with said cylindrical land portion thereof, said first auxiliary pin being movable in said retracted position thereof when the proper key is inserted into said channel to act with the actuating land portions of the proper key on said actuation surface portions of the first auxiliary pin protruding into said channel and shifting said first auxiliary pin into said retracted position thereof thereby removing the engagement between said ball and said cylindrical land portion and allowing said locking formations of said ball to be released from said first groove thereby to allow free rotation between said plug and said casing and wherein said second auxiliary pin unit comprises a second longitudinal groove in said inner wall facing said plug, a second radial hole in said plug, said second radial hole having one end thereof opening into said channel and a second end thereof opening into said second longitudinal groove when said plug is in said normal key insertion angular position thereof, a second auxiliary pin slidingly arranged in said radial hole and having on one end thereof said second actuation surface portions and on the opposite end thereof said second locking formations, said second auxiliary pin being movable in said second radial channel normally from a radially retracted position, in which said second auxiliary pin is out of engagement with said second longitudinal groove and allows free relative rotation of said plug with respect to said casing and in which said second actuation surface portions thereof protrude into said channel, into a radially expanded position in which said second locking formations of said auxiliary pin engage said second longitudinal groove upon actuation of said second actuation surface portions by land portions of the bogus key.

* * * * *